US005772472A

United States Patent [19]

Beutler et al.

[11] Patent Number: 5,772,472

[45] Date of Patent: Jun. 30, 1998

[54] TERMINAL BLOCK FOR HIGH TRANSMISSION RATES

[75] Inventors: Petra Beutler; Sabine Zimmer; Dieter Gerke; Ferenc Nad; Frank Mössner, all of Berlin, Germany

[73] Assignee: Krone Aktiengesellschaft, Berlin-Zehlendorf, Germany

[21] Appl. No.: 722,357

[22] Filed: Sep. 27, 1996

[30] Foreign Application Priority Data

Sep. 29, 1995 [DE] Germany ..... 195 37 532.7
Apr. 4, 1996 [DE] Germany ..... 196 14 788.3

[51] Int. Cl.[6] ..... H01R 13/648

[52] U.S. Cl. ..... 439/608; 439/717

[58] Field of Search ..... 439/608, 108, 439/404, 405, 709, 715, 717

[56] References Cited

U.S. PATENT DOCUMENTS 4,571,014 2/1986 Robin et al. ..... 439/608
5,160,273 11/1992 Carney .

*Primary Examiner*—Khiem Nguyen
*Assistant Examiner*—Yong Ki Kim
*Attorney, Agent, or Firm*—McGlew and Tuttle

[57] ABSTRACT

A terminal block for high transmission rates in the telecommunication and data technique, comprising a plastic body with chambers disposed in at least one row for insulation displacement contact elements and slots for shield plates disposed in the transverse walls between said chambers and extending with parallel axes thereto. The shield plates of at least one chamber are connected by narrow webs inserted in grooves in the bottom of plastic body.

25 Claims, 5 Drawing Sheets

TERMINAL BLOCK FOR HIGH TRANSMISSION RATES

FIELD OF THE INVENTION

The present invention relates to a terminal block for high transmission rates in telecommunication and data communication applications, comprising a plastic body with chambers disposed in at least one row for insulation displacement contact elements and slots for shield plates disposed in the transverse walls between said chambers and extending with parallel axes thereto.

BACKGROUND OF THE INVENTION

A terminal block of the type referred to hereinbefore is known in the art from U.S. Pat. No. 5,160,273. Herein it is intended to solve the problem of crosstalk through the cable wires connected to adjacent insulation displacement contact elements by insertion of a multitude of electrically conductive shield plates between the individual pairs of insulation displacement contact elements. The problem of crosstalk occurs at the transmission of large information volumes by electrical lines, the information being transmitted at high frequencies. The transmission at such high frequencies causes radiation and interference between adjacent cable wires, in particular when these cable wires are disposed closely adjacent to each other in the terminal block. By insertion of the electrically conductive shield plates a higher crosstalk attenuation at high frequencies is achieved.

The prior art terminal block comprises two parallel rows of chambers for insulation displacement contact elements, one shield plate each being assigned thereto and the opposite shield plates of the two rows being connected by a large-area connection plate being inserted into the respective lower part of the terminal block. Application of large-area, electrically conductive shield plates requires however an increase of the constructional volume of the terminal blocks and higher costs for the manufacture of the terminal blocks.

SUMMARY AND OBJECTS OF THE INVENTION

It is therefore the object of the invention to provide a terminal block, wherein the configuration of shield plates is appreciably simplified, so that they can be installed at technically and economically reduced expense.

It is also the object of the invention to provide a terminal block, wherein by the configuration of specially shaped shield plates an effective reduction of crosstalk and a substantial simplification of assembly of the shield plates and of the cable wires at the insulation displacement contact elements is guaranteed.

The solution of this object is achieved, according to the invention, by that the chambers of a terminal unit are disposed in the plastic body at the lowest possible distance to each other, and that the slots for receiving the shield plates are provided from the lower side in the thicker transverse wall between two adjacent terminal units each. Thereby it is possible, by means of only two shield plates, to shield a pair of chambers forming a terminal unit and disposed at a small distance to each other in the plastic body. The larger distance between the chambers of adjacent terminal units reduces the risk of crosstalk.

In a preferred embodiment, the shield plates have in the upper section a latch opening cooperating with a latch lug in the plastic body when inserting the shield plate into the terminal block. The shield plates are inserted from the lower side into the terminal block. Further, the shield plates have in the area of the contact pin a cutout providing for a favorable cable guiding. The transmission properties are improved and favorably influenced by this measure. The shield plates are connected to each other by the contact pins and a circuit track, for example on a printed circuit board.

The configuration of the cable wire introduction section of the insulation displacement contact element as provided in a preferred embodiment according to the invention permits an easier termination of cable wires by in that the cable wires brought in place by hand are reliably attached by a tool prior to pressing-in by the knubs in the introduction section.

According to another embodiment, the shield plates of at least one chamber are connected by narrow webs inserted in grooves in the bottom of the plastic body. This configuration of the shield plates allows a technically and economically less expensive installation of the shield plates immediately in the upper part of the terminal block, so that the configuration of the shield plates according to the invention is also possible for wire connectors comprising one row only of chambers for insulation displacement contact elements and having no lower part.

Further according to the invention, the chambers are arranged pairwise at a small distance to each other in the plastic body, and the slots for receiving the shield plates are disposed in the thicker transverse wall between two adjacent pairs each of chambers arranged side-by-side. Thereby it is possible to shield a pair of chambers located at a small distance to each other in the plastic body by two shield plates only.

Moreover, three shield plates of two adjacent pairs of chambers can be connected to each other by narrow webs to form a shield plate cage. The three shield plates and the narrow webs connecting them form in the plane of the webs the shape of an eight consisting of seven short sheet-metal strips.

In a particularly preferred manner are disposed one slot each in the transverse wall between two pairs of closely adjacent chambers and two slots each in the transverse wall between two pairs each of closely adjacent chambers for receiving the shield plates. Hereby a particularly compact construction of in particular a wire connector is made possible. By the pair-wise configuration of the chambers at a small distance to each other in a row of the plastic body, crosstalk attenuation of the insulation displacement contact elements inserted in these chambers is further improved, the more since the distance of each pair of closely adjacent chambers to the adjacent pair is larger than the distance of closely adjacent chambers. Hereby the capacities of adjacent pairs of insulation displacement contact elements arranged in a row are further decreased, and the crosstalk properties are even further improved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

Figure 9:
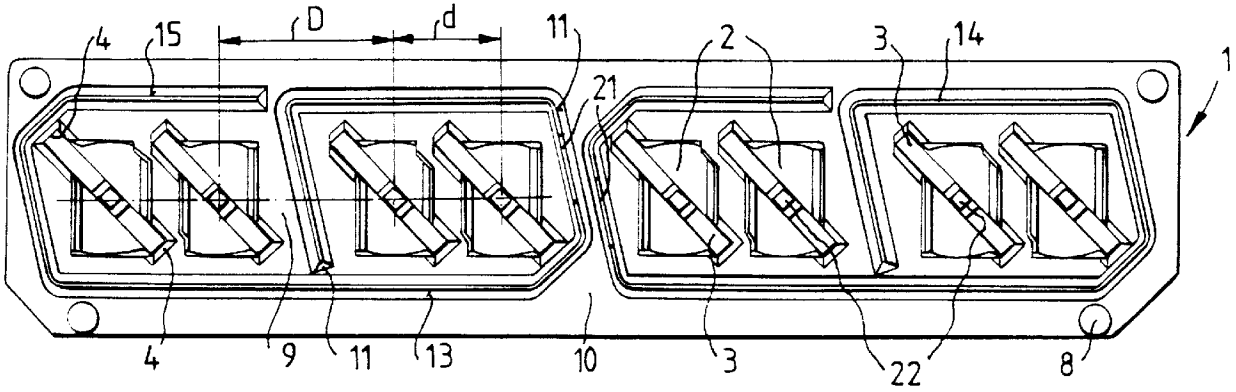
Figure 8:
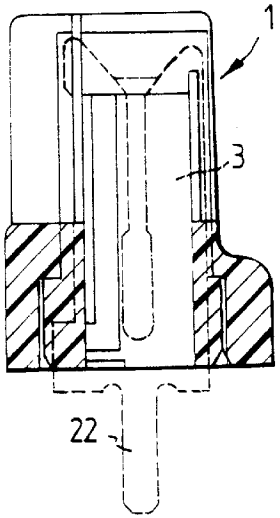
Figure 7:
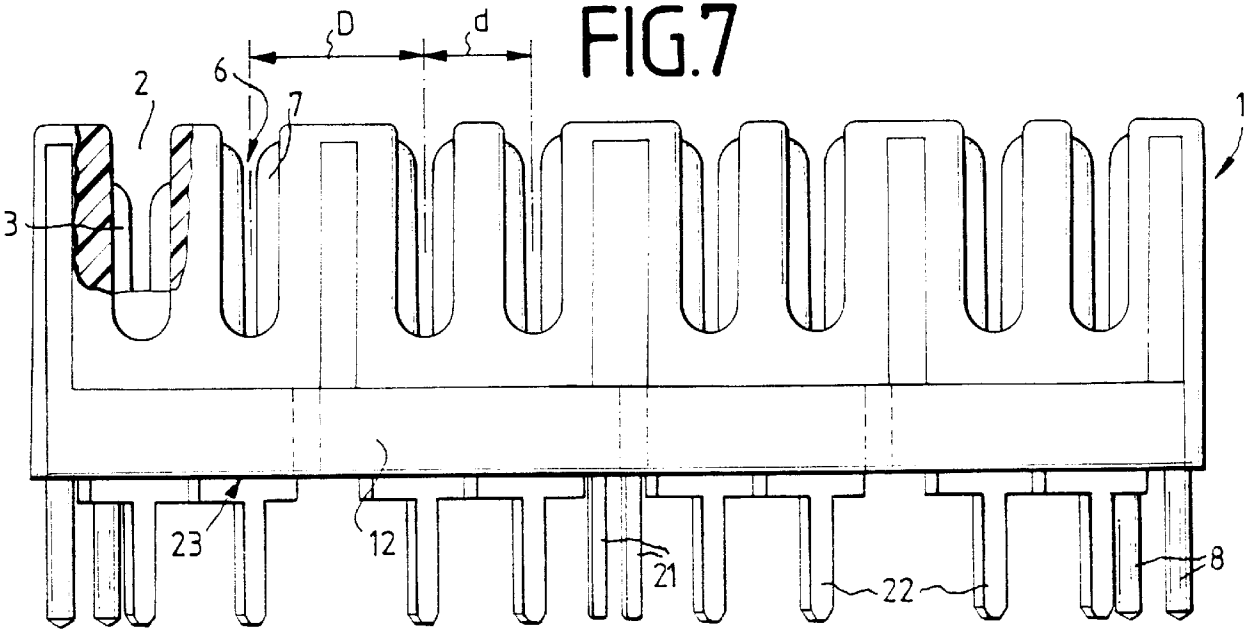
FIG. 7 is a partially sectional side view of a terminal block.
Figure 10:
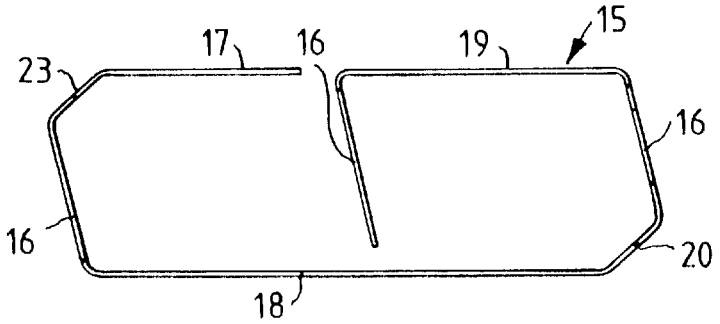
Figure 11:
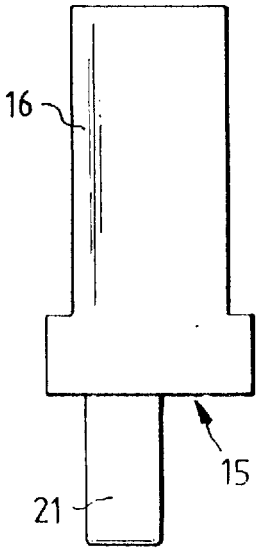

FIG. 8 a partially sectional front view of the terminal block of FIG. 7;

FIG. 9 is a bottom view of the terminal block of FIGS. 7, 8 with shield plate cages;

FIG. 10 is a bottom view of a shield plate cage;

FIG. 11 is a side view of the shield plate cage of FIG. 10; and

Figure 12:
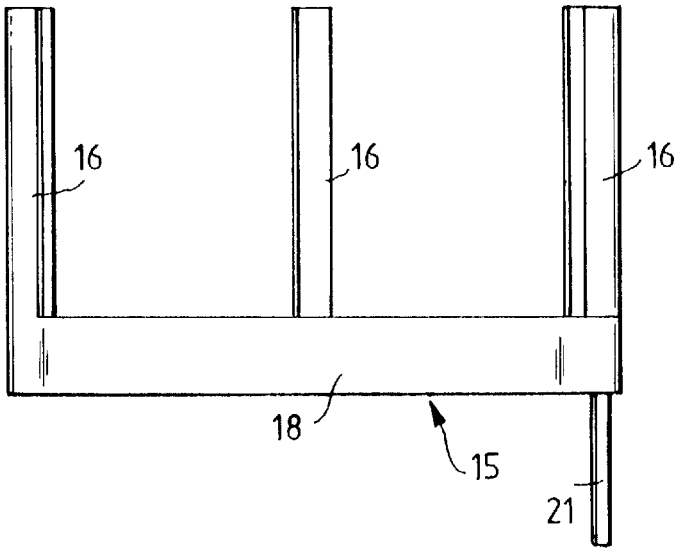

FIG. 12 is a front view of the shield plate cage of FIG. 10.

DETAILED DESCRIPTION OF THE PREFERRED EMBODIMENT

Figure 1:
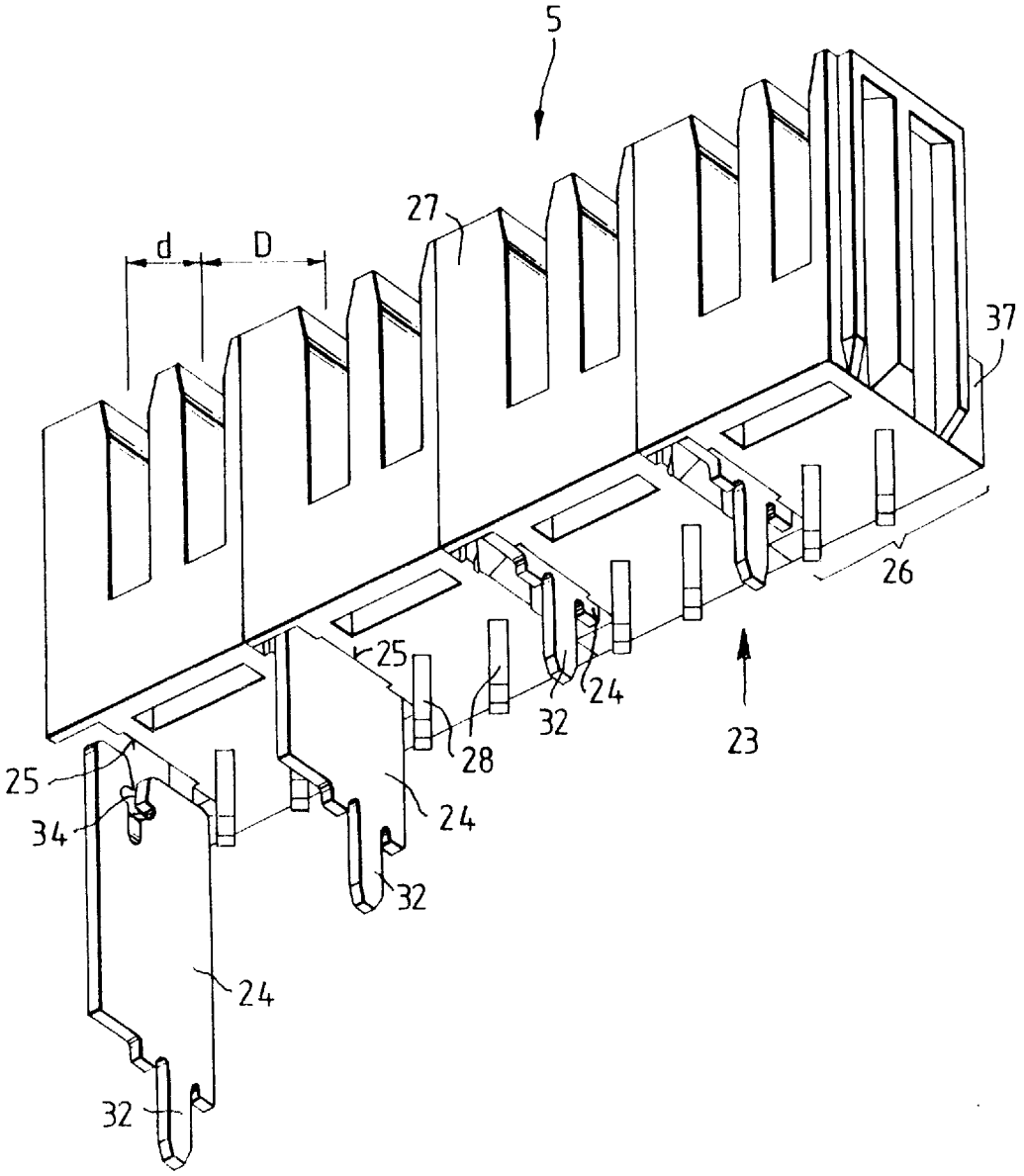
FIG. 1 is a perspective top view of the lower side of the terminal block comprising shield plates inserted in different stages.

According to the representation in FIG. 1, the terminal block is formed of a plastic body 1 comprising four terminal units 26 with two chambers 2 each disposed at a distance d. The chambers 2 are formed from the upper side 5 of the terminal block and serve for receiving insulation displacement contact elements 28. Each pair of chambers 2 of a terminal unit 26 is limited by a transverse wall 27, wherein a slot 25 is provided from the lower side 23 for the insertion of a shield plate 24 with a contact pin 32. The distance d between the chambers 2 of terminal unit 26 is substantially smaller than the distance D between the chambers 2 of adjacent terminal units 26. The distance D is at least 1.5 times the distance d. Each terminal unit 26 consists of a pair of chambers 2 comprising the insulation displacement contact elements 28 and a shield plate 24. The shield plate 24 shown on the left-hand side of FIG. 1 is only then necessary, when another terminal block is added. The terminal block can also be formed of plastic body assemblies separate for each terminal unit 26, said assemblies being combined to an arbitrary number of terminal units 26. The plastic bodies 1 can be lined up with the front sides 37 either smoothly or by latch elements.

Figure 2:
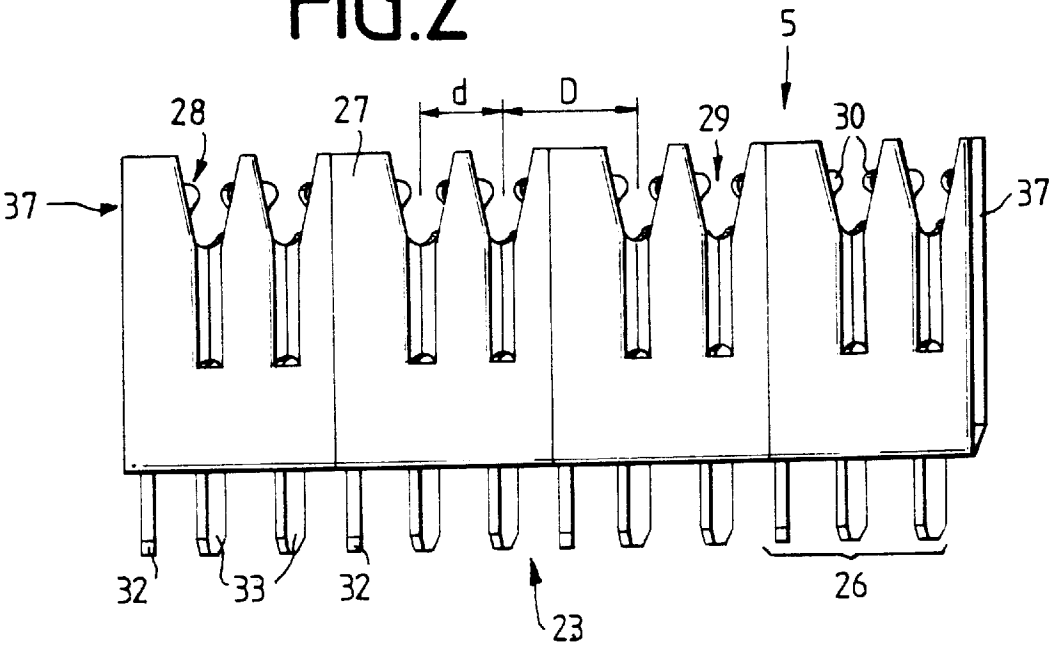
FIG. 2 is a side view of the terminal block of FIG. 1 with inserted shield plates.

In FIG. 2 there is shown, in the side view of the terminal block, the position of the insulation displacement contact elements 28 in the plastic body 1 and the configuration of the individual terminal units 26 and the distances d between the chambers 2 of a terminal unit 26 and to the adjacent terminal units 26. The insulation displacement contact elements 28 are accessible from the upper side 5 of the terminal block.

Figure 6:
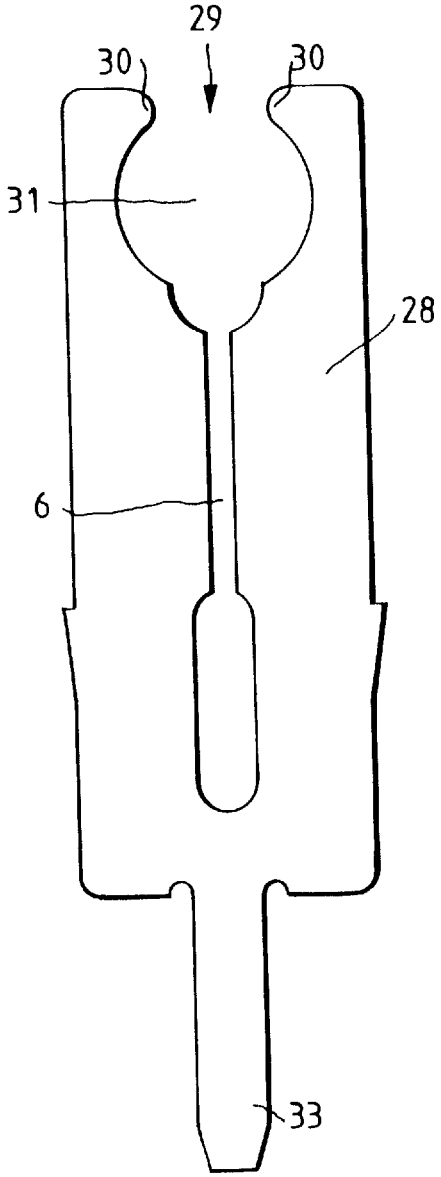
FIG. 6 is the side view of an insulation displacement contact element.

According to the representation of FIG. 6, the insulation displacement contact elements 28 have an introduction section 29 for not shown cable wires, said section being formed of opposite knubs 30 limiting a circular expanded portion 31 towards top. Thereby a cable wire inserted by hand into the expanded portion 31 is pre-fixed and can be pressed in without problems by a suitable tool into the clamping slot 6.

Figure 3:
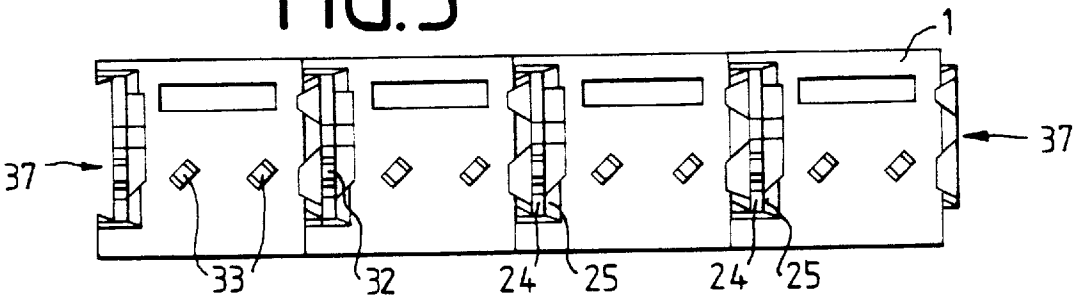
FIG. 3 is a top view of the lower side of the terminal block of FIG. 2.

FIG. 3 shows, in a bottom view of the terminal block, the position of the contact pins 33 of the insulation displacement contact elements 28 and of the contact pins 32 of the shield plates 24 relative to each other and to the lower side 23 of the terminal block.

Figure 4:
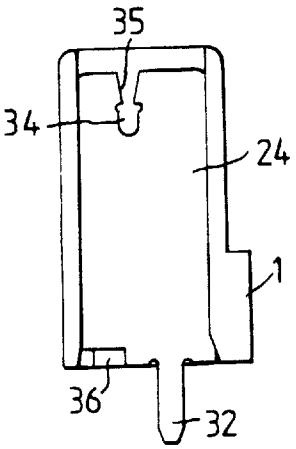
FIG. 4 is a sectional representation of the terminal block of FIG. 2 at the position of an inserted shield plate.
Figure 5:
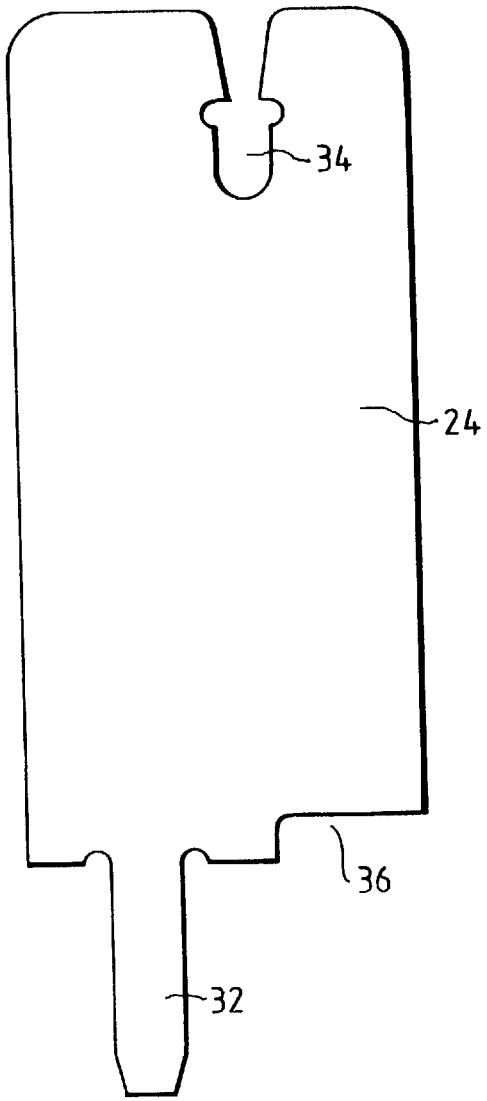
FIG. 5 is the side view of a shield plate.

From FIG. 5 there can be seen the configuration of the shield plates 24. The shield plates 24 have a latch opening 34 cooperating with respective latch lugs 35 in the upper section of the plastic body 1 (FIG. 4). In the area of the contact pin 32 is provided a cutout 36 in order to guarantee optimum wire guiding.

The position of the shield plates 24 in the plastic body 1 is shown in FIG. 4. It becomes apparent that the rest surface of the shield plate 24 is reduced. The contact pin 32 is formed offset relative to the longitudinal axis of the shield plate 24, so that there is sufficient space for the cutout 36.

In another embodiment according to FIGS. 7 to 12, each chamber 2 comprises, as is shown in FIG. 7, a clamping slot 6 with lateral clamping webs 7 for clamping down the insulation of a cable wire, the conductor of which is pressed into the insulation displacement contact element 3 and is contacted in solderless, screwless and stripless manner with the insulation displacement contact element 3. On the lower side 23 of the plastic body 1 are formed fixing pins 8 made of plastic, said pins serving for attachment of the wire connector, for example on printed circuit boards.

As is shown in FIGS. 7 and 9, the distance d between two immediately adjacent clamping slots 6 serving for the insertion of a pair of insulation displacement contact elements 6 is appreciably smaller than the distance D between the clamping slot 6 of the chamber 2 of the one pair ad the clamping slot 6 of the chamber 2 of the adjacent pair. In the transverse wall 9 formed between two pairs of closely adjacent chambers 2 is provided from the lower side 21 a slot 11, and in the wider transverse wall 10 disposed between two groups of closely adjacent pairs are provided from the lower side 23 two slots 11 being connected on the lower side 23 in the bottom 12 of the wire connector by grooves 13, 14, 15, as it is shown in the bottom view in FIG. 9.

Into the slots 11 and grooves 12 to 14 of two adjacent pairs of chambers 2 or two adjacent groups of chambers 2, resp., is inserted a shield plate cage 15 as shown in FIGS. 10 to 12. The cage comprises three shield plates 16 inserted from the lower side 23 into the slots 11 between the pairs of adjacent chambers 2 in the plastic body 1, and further narrow webs 17, 18, 19 snap-fitted in the bottom grooves 12 to 14 of the plastic body 1, when the shield plates 16 are fully slid into the respective slots 11.

The three shield plates 16 and the narrow webs 17 to 19 connecting them have in the plane of the webs 17 to 19 the shape of an eight formed of seven short sheet-metal strips, as is shown in FIG. 10. The respectively outside shield plates 16 in the diagonally opposite corners 20 are each slightly bent off, as is shown in FIG. 10.

In order that the two shield plate cages 15 of the plastic body 1 of a wire connector shown in FIGS. 7 to 9 fit, a slot 11 is formed in the transverse wall 9 between the two pairs of closely adjacent chambers 2, and two parallel slots 11 each are formed in the transverse wall 10 between two groups of pairs each of chambers 2 disposed closely side-by-side for receiving the shield plates 16 of the respective shield plate cage 15.

Each of the two shield plate cages 15 has in the central area of the plastic body 1 of the wire connector wherein two parallel slots 11 for two shield plates 16 are provided in the transverse wall 10, one earthing tapping portion 21 each of the lower side of the shield plates 16, as is shown in FIGS. 7, 11 and 12. These are connected to a not shown earthing position of a not shown printed circuit board. The individual insulation displacement contact elements 3 have contact pins 22 projecting from the lower side for connection to the respective circuit tracks of the printed circuit board.

In another embodiment, the plastic body 1 comprises four pairs of two closely adjacent chambers 2 each for one insulation displacement contact element 3 each, which are each diagonally inserted into cutouts 4 in the opposite corners of the chamber 2. Each chamber 2 for an insulation displacement contact element 3 comprises on the upper side 5 a clamping slot 6 with lateral clamping webs 7 for clamping down the insulation of a cable wire, the conductors of which are pressed into the insulation displacement contact element 3 and are contacted in a solderless, screwless and strapless manner with the insulation displacement contact element 3. On the lower side of the plastic body 1 there are provided fixing pins 8 also formed of plastic, the fixing pins 8 serving for fixing the wire connector, for example on printed circuit boards.

As is shown in FIGS. 7 and 9, the distance d between two immediately adjacent clamping slots 6 serving for the insertion of a pair of insulation displacement contact elements 6 is appreciably smaller than the distance D between the clamping slot 6 of the chamber 2 of the one pair and the clamping slot 6 of the chamber 2 of the adjacent pair. From the lower side 21 in the transverse wall 9 formed between two pairs of closely adjacent chambers 2 there is provided a slot 11. From the lower side 23 in the wider transverse wall 10 disposed between two groups of closely adjacent pairs there are provided two slots 11. The slots 11 are connected on the lower side 23 in the bottom 12 of the wire connector by grooves 13, 14, 15, as it is shown in the bottom view in FIG. 3. Into the slots 11 and grooves 12 to 14 of two adjacent pairs of chambers 2 or two adjacent groups of chambers 2, respectively, there is inserted a shield plate cage 15 as shown in FIGS. 10 and 12. This cage 15 comprises three shield plates 16 inserted from the lower side 23 in the plastic body 1 into the slots 11 between the pairs of adjacent chambers 2. Additionally, narrow webs 17, 18, 19 are snap-fitted in the bottom grooves 12 to 14 of the plastic body 1, when the shield plates 16 are fully slid into the respective slots 11. The webs 17, 18, 19 are narrow relative to the shield plates 16. Specifically, the shield plates have a height dimension and each web has a height dimension, the web height dimension being smaller than the shield plates height dimension. Preferably the shield plates height dimension is more than twice the web height dimension. Further, the shield plates height dimension may be more than three times the web height dimension. Further the shield plates height dimension may be more than four times the web height dimension and further still, the webs may be very narrow, with the shield plates height dimension more than five times the web height dimension. Each web 17, 18, 19 is disposed extending substantially parallel to the direction of extent of the shield plates 16.

The three shield plates 16 and the narrow webs 17 to 19 connecting them have in the plane of the webs 17 to 19 the shape of an eight formed of seven short sheet-metal strips, as is shown in FIG. 10.

The respectively outside shield plates 16 in the diagonally opposite corners 20 are each slightly bent off, as is shown in FIG. 10.

In order that the two shield plate cages 15 of the plastic body 1 of a wire connector shown in FIGS. 7 to 9 fit, a slot 11 is formed in the transverse wall 9 between the two pairs of closely adjacent chambers 2, and two parallel slots 11 each are formed in the transverse wall 10 between two groups of pairs each of chambers 2 disposed closely side-by-side for receiving the shield plates 16 of the respective shield plate cage 15.

Each of the two shield plate cages 15 has in the central area of the plastic body 1 of the wire connector wherein two parallel slots 11 for two shield plates 16 are provided in the transverse wall 10, one ground (earthing) tapping portion 21 each on the lower side of the shield plates 16, as is shown in FIGS. 7, 11 and 12. These are connected to a not shown ground (earthing) position of a not shown printed circuit board. The individual insulation displacement contact elements 3 have contact pins 22 projecting from the lower side for connection to the respective circuit tracks of the printed circuit board. While a specific embodiment of the invention has been shown and described in detail to illustrate the application of the principles of the invention, it will be understood that the invention may be embodied otherwise without departing from such principles.

What is claimed is:

1. A telecommunications and data transfer terminal block for high transmission rates, comprising:

a plastic body with chambers disposed substantially in a row, slots defined in transverse walls between said chambers and extending with parallel axes thereto and grooves in a bottom of said plastic body;

insulation displacement contact elements, each element being disposed in one of said chambers;

shield plates, each of said shield plates being disposed in one of said slots;

a web inserted in one of said grooves, said web connecting one of said shield plates adjacent to one of said chambers to another of said shield plates adjacent to another of said chambers, three of said shield plates of two adjacent pairs of chambers being connected to each other by said web and by an additional web to form a shield plate cage.

2. A terminal block according to claim 1, wherein said shield plates have a height dimension and said web has a height dimension, said web height dimension being smaller than said shield plates height dimension.

3. A terminal block according to claim 2, wherein said shield plates height dimension is more than twice said web height dimension.

4. A terminal block according to claim 2, wherein said shield plates height dimension is more than three times said web height dimension.

5. A terminal block according to claim 2, wherein said shield plates height dimension is more than four times said web height dimension.

6. A terminal block according to claim 2, wherein said shield plates height dimension is more than five times said web height dimension.

7. A terminal block according to claim 2, wherein each web is disposed extending substantially parallel to the direction of extent of the shield plates.

8. A terminal block according to claim 1, wherein said chambers are arranged pairwise at a distance (d) to each other, separated by one of a plurality of transverse walls formed in said plastic body, and said slots each being partially formed in one of said transverse walls between two adjacent pairs each of chambers arranged side-by-side.

9. A terminal block according to claim 1, wherein said three shield plates and web and said another web form in a plane a shape of an eight consisting of seven short sheet-metal strips.

10. A terminal block according to claim 9, wherein one of said slots is disposed in a transverse wall between two pairs of closely adjacent chambers, and two of said slots each are disposed in a transverse wall between two pairs each of closely adjacent ones of said chambers for receiving shield plates.

11. A telecommunications and data transfer terminal block for high transmission rates, comprising:

plastic body means formed of a plurality of terminal units, each terminal unit including:

chambers disposed substantially in at least one row, a slot defined by transverse walls and at least one slot of said plastic body means extending between chambers of one of said terminal units and chambers of an adjacent one of said terminal units and extending with parallel axes to said chambers, said slot having a bottom opening in a bottom of said plastic body, insulation displacement contact elements, each element being disposed in one of said chambers;

a shield plate disposed in at least said at least one slot, said chambers of each terminal unit being provided in said plastic body spaced a distance (d) from each other and said shield being provided in said at least one slot from a lower side of said plastic body means, wherein said distance (d) between chambers of a terminal unit is substantially smaller than a terminal unit distance (D) between chambers of adjacent terminal units.

12. A terminal block according to claim 11, wherein said shield includes a latch opening connecting with a latch lug in said plastic body.

13. A terminal block according to claim 11, wherein said shield plates have in the area of the contact pin a cutout for cable guiding.

14. A terminal block according to claim 11, wherein insulation displacement contact elements are inserted in said chambers with a cable fixing portion in the introduction section.

15. A terminal block according to claim 11, wherein shield plates of at least one chamber are connected to each other by narrow webs inserted in grooves in the bottom of said plastic body.

16. A terminal block according to claim 11, wherein three shield plates of two adjacent pairs of chambers are connected to each other by narrow webs to form a shield plate cage.

17. A terminal block according to claim 16, wherein three shield plates and narrow webs connecting them form in the plane thereof the shape of an eight consisting of seven short sheet-metal strips.

18. A terminal block according to claim 16, wherein one slot is disposed in a transverse wall between two pairs of closely adjacent chambers, and two slots each are disposed in another transverse wall between two pairs each of closely adjacent chambers for receiving shield plates.

19. A terminal block according to claim 11, wherein three or more terminal units are provided forming said plastic body means with said slot of each of two of said terminal units receiving one said shield plate, said shield plate including a contact pin, said terminal block being provided in combination with a printed circuit board with at least one circuit track, said shield plate of one of said two of said terminal units being connected with said shield plate of another of said two of said terminal units by said at least one circuit track.

20. A telecommunications and data transfer terminal block for high transmission rates, comprising:

a terminal unit with a terminal unit plastic body defining chambers disposed substantially in at least one row, a terminal unit slot formed by said terminal unit plastic body extending with parallel axes to said chambers of said terminal unit plastic body, said terminal unit slot having a bottom opening in a bottom of said terminal unit plastic body terminal unit insulation displacement contact elements, each element being disposed in one of said chambers;

a terminal unit shield plate disposed in said terminal unit slot;

another terminal unit with another terminal unit plastic body defining chambers disposed substantially in at least one row, another terminal unit slot formed by said another terminal unit plastic body extending with parallel axes to said chambers of said another terminal unit plastic body, said another terminal unit slot having a bottom opening in a bottom of said another terminal unit plastic body, another terminal unit insulation displacement contact elements, each element of said another terminal unit insulation displacement contact elements being disposed in one of said chambers of said another terminal unit plastic body, said terminal unit being connected to said another terminal unit to form the terminal block with said terminal unit slot adjacent to said another terminal unit and with said another terminal unit slot adjacent to an end of said another terminal unit which is opposite said terminal unit and to provide a terminal unit distance (D) between chambers of adjacent connected terminal units, said chambers of said terminal unit being spaced a distance (d) from each other and said chambers of said another terminal unit being spaced said distance (d) from each other, said distance (d) being substantially smaller than said terminal unit distance (D) between chambers of adjacent terminal units said shield being provided in said terminal unit slot from a lower side of said terminal unit.

21. A terminal block according to claim 20, wherein said shield includes a latch opening connecting with a latch lug in said terminal unit plastic body.

22. A terminal block according to claim 20, further comprising a further terminal unit, said another terminal unit having another terminal unit shield plate in said another terminal unit slot, said terminal unit shield plate including a contact pin, and said another terminal unit shield plate including a contact pin, the terminal block being provided in combination with a printed circuit board with at least one circuit track, said terminal unit shield plate being connected with said another terminal unit shield plate by said at least one circuit track.

23. A terminal block according to claim 20, wherein said terminal unit plastic body is a single integral plastic body and said another terminal unit plastic body is another single integral plastic body, said terminal unit and said another terminal unit each having a front side and a back side, said terminal unit and said another terminal unit being connected at a back side of said terminal unit and at a front side of said another terminal unit via latch means.

24. A terminal block according to claim 20, wherein said terminal unit plastic body and said another terminal unit plastic body are connected as a single integral plastic body means.

25. A terminal block according to claim 20, further comprising another terminal unit shield plate disposed in said another terminal unit slot.

* * * * *